United States Patent [19]

Schaeflern

[11] 4,147,043

[45] Apr. 3, 1979

[54] CARRIAGE DRIVE FOR A FLAT BED KNITTING MACHINE

[75] Inventor: Henry Schaeflern, Pittstown, N.J.

[73] Assignee: The Singer Company, New York, N.Y.

[21] Appl. No.: 881,312

[22] Filed: Feb. 27, 1978

[51] Int. Cl.[2] ..... D04B 7/00

[52] U.S. Cl. ..... 66/60 R

[58] Field of Search ..... 66/60, 62, 64, 78

[56] References Cited

FOREIGN PATENT DOCUMENTS

| | | | |
|---|---|---|---|
| 464984 | 8/1951 | Italy | 66/64 |
| 506373 | 12/1954 | Italy | 66/64 |
| 624519 | 9/1961 | Italy | 66/64 |

*Primary Examiner*—Ronald Feldbaum

*Attorney, Agent, or Firm*—William V. Ebs; Robert E. Smith; Edward L. Bell

[57] ABSTRACT

A carriage drive is provided for a flat bed home type knitting machine. Such carriage drive includes a reversible electric motor, a pair of motor driven capstans, and wire rope which winds on one capstan and unwinds on the other when the motor rotates, the rope being connected to opposite ends of the carriage of the machine.

10 Claims, 2 Drawing Figures

CARRIAGE DRIVE FOR A FLAT BED KNITTING MACHINE

BACKGROUND OF THE INVENTION

1. Field of the Invention

The invention relates to home type flat bed knitting machine and more particularly to carriage drives for such machines.

2. Description of the Prior Art

It is well known to provide home type knitting machines with carriage drive means including a motor, a driving belt or threaded shaft, and a carriage connected fixture driven by the belt or threaded shaft. It is a disadvantage of the prior art drives, however, that the belt or threaded shaft extends a substantial distance beyond each end of the bed of the machine thereby increasing its length to an undesirable extent, this being necessary to enable the carriage to move across all of the knitting needles in the bed.

SUMMARY OF THE INVENTION

In accordance with the invention a carriage drive for a home type knitting machine is provided with a pair of capstans that are driven by a reversible electric motor. Wire rope extends over the capstans and connects to opposite end portions of the carriage. As the motor is operated the wire rope winds up on one capstan and unwinds on the other causing the carriage to be moved across the machine bed in a direction dependent upon the direction of rotation of the motor. The drive does not extend any substantial distance beyond the ends of the machine and yet enables the carriage to be moved across all of the needles in the bed. Furthermore the drive is supported in a manner enabling it to be easily attached to or removed from a knitting machine.

DESCRIPTION OF THE INVENTION

Figure 1:
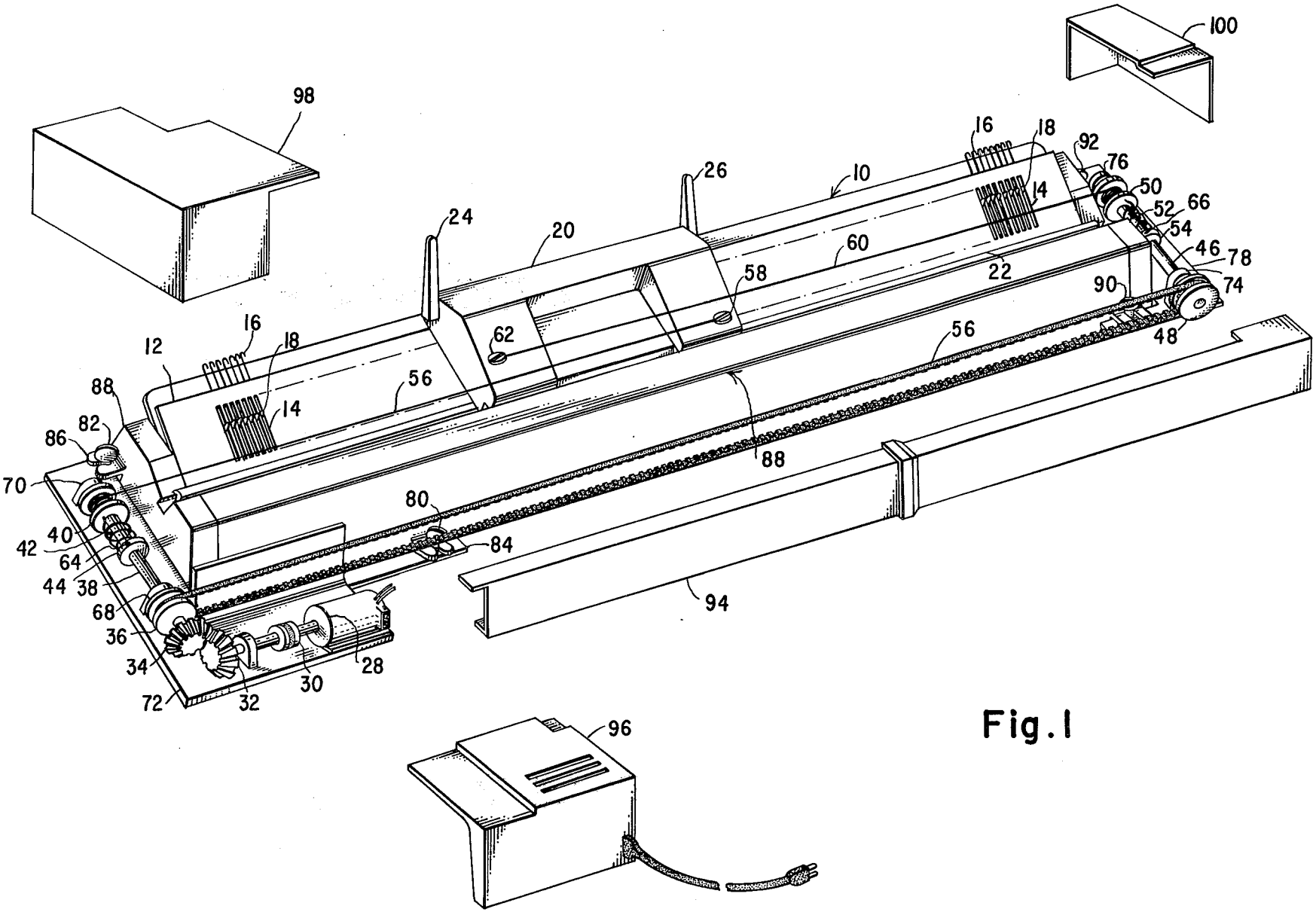
FIG. 1 is a rear perspective view of a knitting machine with a motor drive according to the invention.
Figure 2:
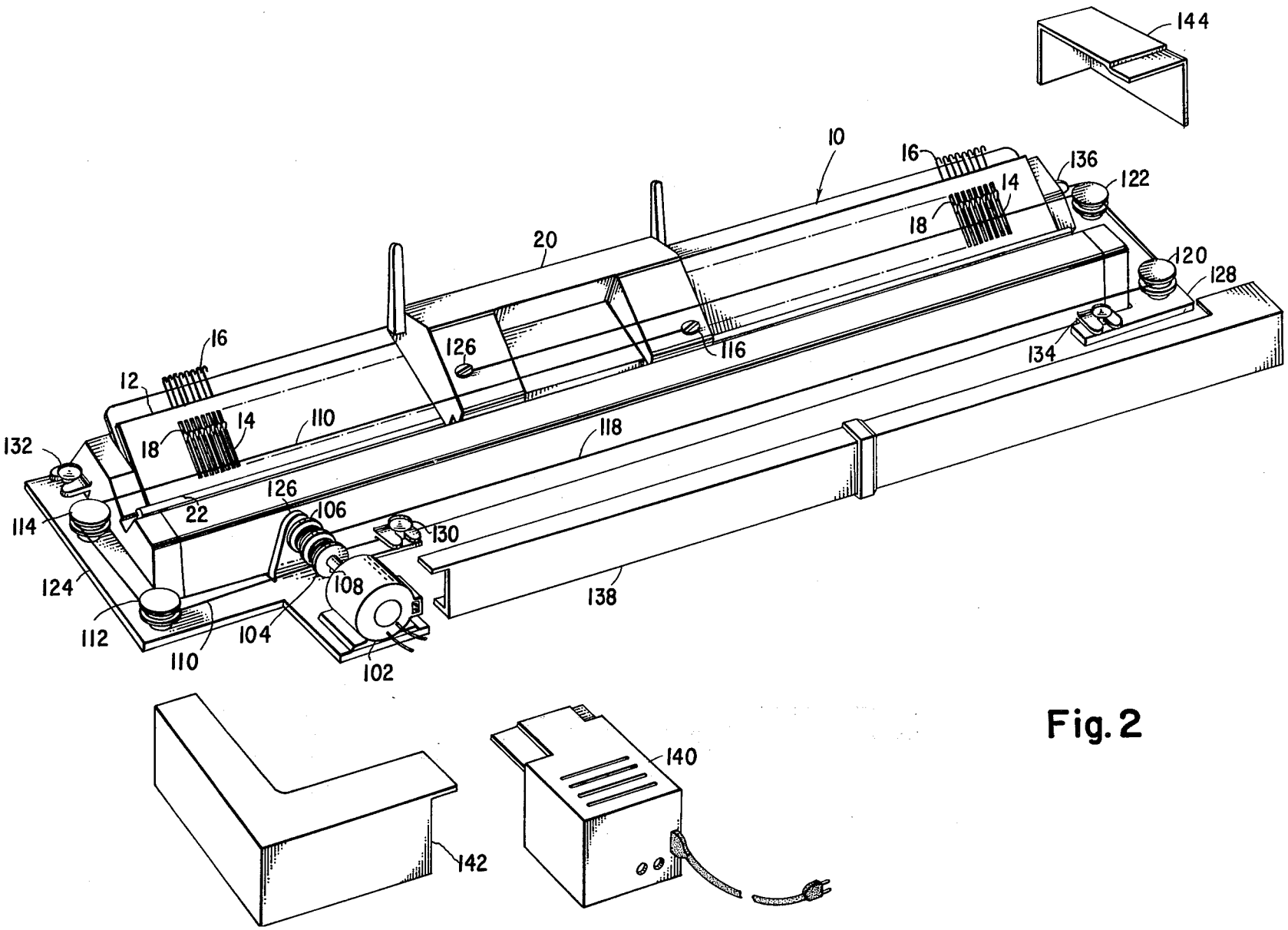
FIG. 2 is a rear perspective view of the knitting machine of FIG. 1 showing a modified form of motor drive according to the invention.

In FIGS. 1 and 2, reference character 10 designates a flat bed home type knitting machine including a needle bed 12 having slots 14 therein extending throughout the length of the bed except for marginal end portions thereof. Each slot is associated with a knitting needle 16 having a butt 18 extending through the slot and actuable by cams (not shown) on the underside of a carriage 20 which slides on a rail 22 secured to the bed 12. As shown, the carriage is provided with handles 24 and 26 which an operator can use to manually move the carriage along the bed.

Motor driven means are also provided in accordance with the invention for moving the carriage back and forth along the bed, and causing cams in the carriage to move the needles as required for the knitting of fabric. Referring to FIG. 1 showing one form of motor drive according to the invention, reference character 28 denotes a reversible electric motor which drivably connects through a slip clutch 30 and meshing gears 32 and 34 with a toothed driving wheel 36 affixed to a shaft 38. A capstan 40 is rotatably mounted on one end of shaft 38 and is drivably connected to the shaft through a coil spring 42 having one end secured to the capstan and the other end affixed in a boss 44 rotatable with the shaft.

As shown shaft 38 is located just beyond one end of the machine 10. A second shaft 46 is located just beyond the other end of the machine and parallel to the shaft 38. Such second shaft 46 has a toothed driving wheel 48 affixed thereon at one end and has a capstan 50 rotatably mounted thereon at the other end. The capstan 50 is drivably connected with the shaft through spring 52 having one end affixed in the capstan and the other end connected to a boss 54 on the shaft. A toothed timing belt 56 extends over and meshes with teeth of the pulleys 36 and 48.

A rope 56 preferably of wire having one end secured to and wrapped around capstan 40 extends therefrom to the far side of the carriage where it is secured at screw 58. A like rope 60 having one end secured to and wrapped around the capstan 50, and extending from such capstan to what is the far end of the carriage relative to the capstan 50, is secured to the carriage at screw 62. The springs 42 and 52 may be prestressed to remove slack in the ropes 56 and 60 prior to operation of the carriage motor drive. This is accomplished by an operator angularly positioning boss 44 and/or boss 54, as required, on shafts 38 and 46 respectively to which the bosses are secured by set screws 64 and 66, and upon which they may be rotationally adjusted after the screws have been loosened.

Rotation of the motor 28 in one direction results in the clockwise rotation of driving wheel 36 which in turn drives wheel 48 in a clockwise direction through timing belt 56. Wheels 36 and 48 rotate shafts 38 and 46 in a clockwise direction, and the capstans 40 and 50 are rotated in a like direction by the shafts causing rope 60 to be wound onto capstan 50 while rope 56 is unwound from capstan 46, and the carriage 20 is moved to the right as viewed in FIG. 1. Reversal of the direction of rotation of the motor 28 results in the capstans being rotated in a counterclockwise direction, the wire rope 56 being wound upon capstan 40 while wire rope 60 is unwound from capstan 50, and the carriage being moved to the left as viewed in FIG. 1. Conventional motor control circuitry; and suitable switch means, such as shown, for example in U.S. patent application, Ser. No. 788,857 for Carriage Reversing Control for a Flat Bed Knitting Machine filed Apr. 19, 1977, may be provided at opposite ends of the needle bed for actuation by the carriage after needle actuating cams thereon have travelled beyond all needles in the bed, to alter the operation of the motor control circuitry and effect reversals of carriage motion. Slip clutch 30 serves to prevent damage to the carriage motor drive in the event the carriage should jam against needles in the bed and be prevented from moving.

As shown shaft 38 is rotatably supported in journals 68 and 70 which are mounted on a plate 72, and shaft 46 is rotatably supported in journals 74 and 76 which are mounted on another plate 78. Motor 28 is secured to plate 72. The plate 72 attaches to and detaches from the machine 10 at wing nuts 80 and 82 screwed into the plate and respectively engageable with flanges 84 and 86 located on the machine housing 88. Plate 78 similarly attaches to and detaches from the housing 88 at wing nuts 90 and 92. The carriage motor drive is therefor easily affixed to the machine or removed therefrom, it only being necessary to connect or disconnect the wire ropes 56 and 60 to or from the carriage 20 at screws 62 and 58, and to attach or detach the plates 72 and 78 using the wing nuts provided for the purpose. Removable covers 94, 96, 98 and 100 are preferably provided for use over portions of the carriage motor drive after the drive has been attached to the knitting machine.

Referring now to FIG. 2 showing a modified form of motor drive, reference character 102 designats a reversible electric motor which drivably connects with a pair of capstans 104 and 106 affixed to the same shaft 108. A rope 110, preferably of wire, attached to and wound on capstan 104 extends therefrom around rotatable pulleys 112 and 114 to the far side of the carriage 20 where it is attached at screw 116. A like rope 118 is attached to and wound on capstan 106, and such rope 118 extends around rotatable pulleys 120 and 122 to carriage attaching screw 126 on what is the far side of the carriage relative pulleys 120 and 122. Although not shown in FIG. 2 it is to be understood that a slip clutch such as the slip clutch 30 shown in FIG. 1 may be provided in the drive connection between the motor 102 and capstans 104, 106; and an adjustable spring connection as shown at 42 and 44 in FIG. 1 may be provided between the motor 102 and capstans 104, 106 for use in eliminating slack from the ropes 110 and 118.

As will be apparent from FIG. 2, rotation of the motor 102 in a direction resulting in counterclockwise rotation of the capstans 104 and 106 causes rope 110 to be wound onto capstan 104, rope 118 to be unwound from capstan 106, and the carriage 20 to be moved to the left as viewed in the drawing. Reversal of the direction of rotation of the motor causes rope 118 to be wound onto capstan 106 while rope 110 is unwound from capstan 104, and the carriage to be moved to the right. Reversals in the direction of rotation of the motor may be provided for with conventional motor control circuitry including switch means as shown in the aforementioned patent application Ser. No. 788,857 at opposite end portions of the machine bed.

Motor 102 is secured to plate 124 and the shaft is supported in a journal 126 which is affixed to such plate. The pulleys 112 and 114 are also mounted on plate 124, and the pulleys 120 and 122 are mounted on a plate 128. The carriage motor drive attaches to and detaches from the machine at wing nuts 130, 132, 134 and 136, and at screws 116 and 126. Removable covers 138, 140, 142 and 144 are preferably provided for portions of the carriage as shown in FIG. 2.

It is to be understood that the present disclosure relates to preferred embodiments of the invention which are for purposes of illustration only, and that various changes and modifications may be made therein without departing from the spirit and scope of the invention.

Having thus set forth the nature of the invention, what is claimed herein is:

1. A carriage drive for a flat bed knitting machine including a reversible electric motor, a driving connection between the motor and carriage including a pair of capstans and rope having portions affixed to the carriage and portions wrapped around the capstans so as to unwind from one capstan and wind up on the other when the motor turns thereby causing the carriage to be moved across the bed of the machine in a direction determined by the direction of rotation of the motor, the carriage affixed rope portions being connected to opposite end portions of the carriage and being arranged to extend therefrom in opposite directions across substantially the entire length of the carriage to locations adjacent the ends of the machine bed enabling the carriage to be moved by the rope into positions extending beyond the bed and the said locations adjacent to ends of the bed.

2. The combination of claim 1 wherein the capstans are located at opposite end portions of the bed; and said driving connection includes a driving wheel for each capstan, a timing belt between the driving wheels and gearing between the motor and one driving wheel.

3. The combination of claim 2 including an elongated cover for the timing belt.

4. The combination of claim 1 including a needle bed attachment having the electric motor and the capstans mounted thereon.

5. The combination of claim 1 including removable covers for at least portions of the carriage drive.

6. The combination of claim 1 including a slip clutch in said driving connection.

7. The combination of claim 1 including means for spring loading the capstans to provide initial tensions in said rope between the capstans and the carriage.

8. The combination of claim 1 with a common axis of rotation for the capstans and including guide pulleys for rope extending between each capstan and the carriage.

9. The combination of claim 8 including support means for the motor, capstans and guide pulleys attachable to and detachable from the knitting machine.

10. The combination of claim 1 including support means for the motor and capstans attachable to and detachable from the knitting machine.

* * * * *